US007578318B2

(12) United States Patent
Christian

(10) Patent No.: US 7,578,318 B2
(45) Date of Patent: Aug. 25, 2009

(54) WIRE TWISTING TOOL

(76) Inventor: Wayne Harvey Christian, 3042 Sixth Line, Oakville, Ontario (CA) L6M 4J9

( * ) Notice: Subject to any disclaimer, the term of this patent is extended or adjusted under 35 U.S.C. 154(b) by 0 days.

(21) Appl. No.: 11/927,021

(22) Filed: Oct. 29, 2007

(65) Prior Publication Data

US 2009/0107576 A1 Apr. 30, 2009

(51) Int. Cl.
*B21F 15/04* (2006.01)
*B21F 7/00* (2006.01)

(52) U.S. Cl. ..... 140/118; 140/149

(58) Field of Classification Search ..... 140/118, 140/149, 93.2, 93.6, 93 A, 119, 124, 30, 36
See application file for complete search history.

(56) References Cited

U.S. PATENT DOCUMENTS

| | | | |
|---|---|---|---|
| 561,143 | A | 6/1896 | Tinsley |
| 632,324 | A | 9/1899 | Pottenger |
| 1,014,498 | A | 1/1912 | Lung |
| 1,709,908 | A | 4/1929 | Free |
| 2,096,244 | A | 10/1937 | Heinrich |
| 2,214,267 | A | 9/1940 | Bednarek |
| 2,494,832 | A | 1/1950 | Piper |
| 2,857,792 | A | 10/1958 | McNish |
| 2,946,356 | A | 7/1960 | Young |
| 3,030,984 | A | 4/1962 | Vogt et al. |
| 3,131,731 | A | 5/1964 | Gulemi |
| 3,338,273 | A | 8/1967 | Kalning |
| 3,670,784 | A | 6/1972 | Ackerman |
| 3,863,558 | A | 2/1975 | Trumbo |
| 4,091,845 | A | 5/1978 | Johnson |
| 4,114,527 | A | 9/1978 | O'Neill |
| 4,331,183 | A | 5/1982 | Calhoun |
| 4,353,295 | A | 10/1982 | Kandarian |
| 4,413,660 | A | 11/1983 | Conrad |
| 4,694,869 | A | 9/1987 | Wolford, Jr. et al. |
| 4,791,969 | A | 12/1988 | Cinque |
| 5,363,525 | A | 11/1994 | Andreasen |
| 5,758,465 | A | 6/1998 | Logue |
| 6,659,521 | B2 | 12/2003 | Hill et al. |
| 6,669,158 | B2 | 12/2003 | Masas |
| 6,729,358 | B1 | 5/2004 | Moffatt |
| 7,025,317 | B2 | 4/2006 | Masas |
| 7,089,969 | B2 | 8/2006 | Jackson et al. |
| 7,124,786 | B1 * | 10/2006 | Gowhari ..... 140/118 |

* cited by examiner

*Primary Examiner*—Dana Ross
*Assistant Examiner*—Debra M Sullivan
(74) *Attorney, Agent, or Firm*—Gerald A. Gowan; Gowan Intellectual Property

(57) ABSTRACT

A wire twisting tool is provided which is adapted to be used in the installation of wire ties that are used to support a building ceiling, or other ceiling components such as piping, HVAC equipment, or the like. The tool has a central passageway through which a hanging section of wire tie can pass, a oval, coil forming recess around the passageway to allow for the formation of a wire tie coil around the hanging section, and grooved slots extending from the passageway to the end or edge of the tool, to pull or push a free end of the wire tie around the hanging section. Using the tool, an operator can rapidly produce a tight, coil of material around the hanging section, with minimal exertion.

14 Claims, 5 Drawing Sheets

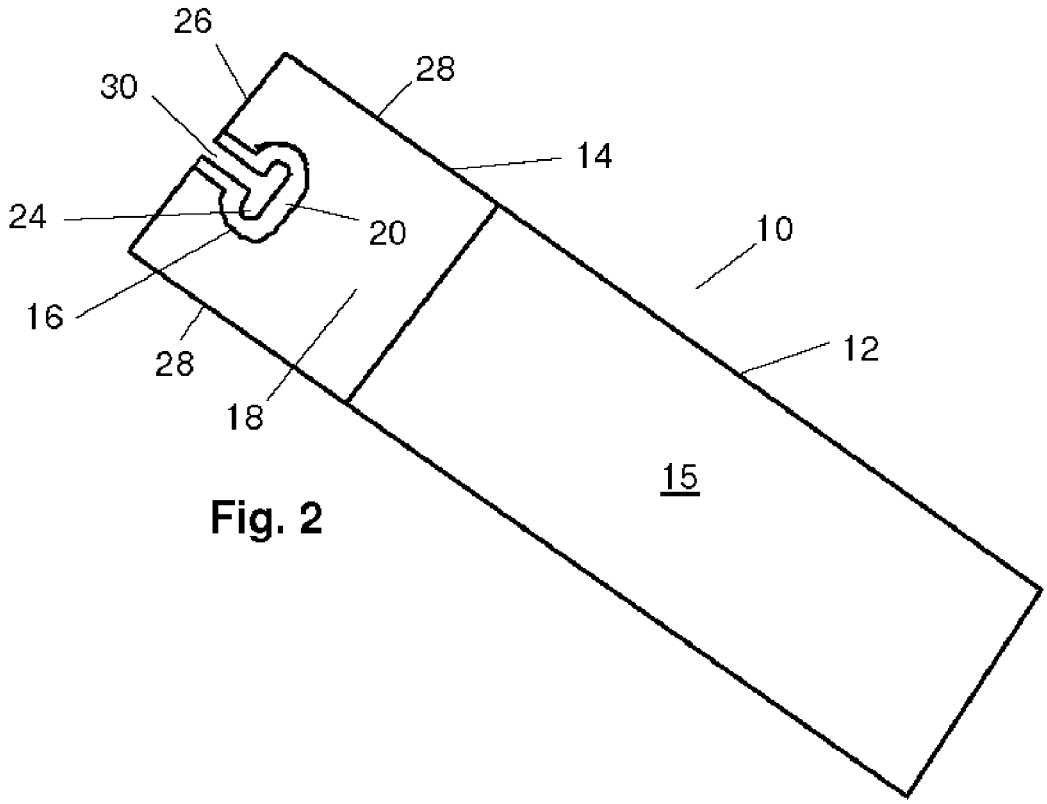
Fig. 2
Fig. 3
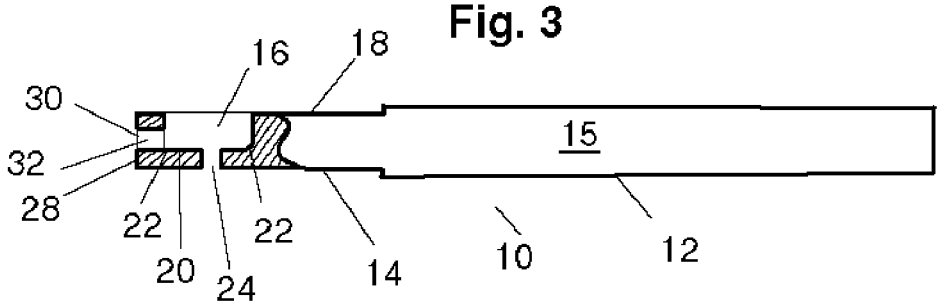
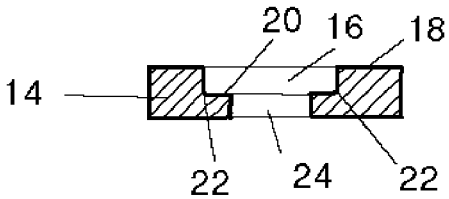
Fig. 4
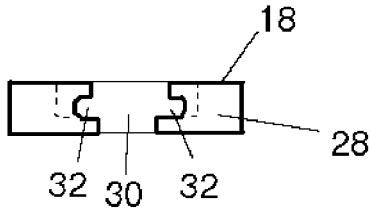
Fig. 5

WIRE TWISTING TOOL

FIELD OF THE INVENTION

The present invention relates to the field of tools, and in particular, relates to a tool for twisting the wire ties which are used to hang suspended ceilings and/or other various ceiling components, such as light fixtures, fans, and the like.

BACKGROUND OF THE INVENTION

Current practice in the construction trade and building industry is to suspend ceiling tiles, acoustic ceiling tiles, fixtures, and the like, with wire ties that are fastened at one end to a bracket which is affixed to building structure such as a ceiling joist, a concrete or masonry pad used to form the roof or floor above, a ceiling panel support grid, and/or brackets affixed to these surfaces. Typically, one end of the wire ties is attached to the support structure and the other end hangs down from this structure. The wire ties are commonly made of from 8 to 12 gauge steel, or the like, and is reasonably resilient in order to provide the strength needed to support the weight of the ceiling or ceiling components. Because a relatively large variety of equipment can be hidden above a suspended acoustic tile ceiling in a commercial building, the wires ties can vary in length from 18 inches to over six to eight feet. Thicker gauge wire ties can also be used in some applications.

In use, the user inserts the hanging free end of the wire tie though a ceiling support bracket, or the like, and then twists the wire around itself in order to hold the wire tie in position. This is commonly done by hand, or with the aid of a pair of pliers.

The most apparent disadvantage of this technique is the cost of labour for the labour intensive task of twisting the wire. For example, in order to be reasonably secure and satisfy some municipal codes, approximately six to eight inches of the wire must be twisted eight to ten turns about itself. In practise, because of the stiffness of the wire tie, it is difficult on the user to use his fingers to twist each wire tie around itself eight or ten times; —particularly when the total number of wire ties to be twisted in a larger ceiling installation can exceed several hundred, or more.

Further, even if the wire ties were twisted for eight to ten turns, the quality of the resultant coil of twisted wire can vary from user to user, or even from one wire tie to the next. Preferably, the resultant coil is closely space so as to form a "tight" coil, in order to provide maximum strength to the wire tie.

However, in practice, many workers in an abbreviated approach, will only twist the wire three or four times about itself in order to conserve time, and to conserve their finger strength. Still, even when only two or three twists are made, the work is time consuming, and can tax the strength of the user's fingers and hands. Further, while this abbreviated approach can save some time, this method of connecting the wire to the bracket is not very secure. Under sufficient stress, the abbreviated wire twist can stretch, and under further stress, the wire can prematurely untwist.

Still another disadvantage of this abbreviated approach is that the connection between the wire tie and the ceiling or ceiling fixture is looser than designed. Under normal circumstances, gravity provides tension between the wire and the bracket. However, in the case of an earthquake, fire or the like, the loose connection allows vibration and movement of the fixtures supported by the wire. This can result in fixtures falling onto emergency workers and other similar hazards.

Various prior art devices have been provided to address this situation. For example, U.S. Pat. No. 4,791,969 issued to Cinque, provides a device for twisting ceiling wires. While his device is intended to be used on the end of a pole, or such, to reach higher installation applications and attach a wire to a support bracket, it provides a mechanism to twist a ceiling wire around itself. However, the Cinque device has a tube in which the hanging wire is fitted, and an angled blade which is adapted to engage and push the free end of the wire. In use, as the tube is twisted around the hanging wire, the blade causes the free end of the wire to twist around the hanging wire.

This approach is not practical in all applications, especially in applications where the wire tie is already hanging from the ceiling support structure, and the user is attempting to hang the ceiling or fixture from the support structure. In particular, Cinque requires free access to the end of the hanging wire in order to insert the hanging end into his tube device. Further, since the blade of Cinque merely rests against the free end of the wire, obtaining a "tight" twist pattern to produce a coil in a specified length, can be difficult. Similar devices are shown by Vogt et al. in U.S. Pat. No. 3,030,984, by Young in U.S. Pat. No. 2,946,356, and by Woolford Jr. et al. in U.S. Pat. No. 4,694,869.

Another patent of interest is U.S. Pat. No. 561,143 to Tinsley which provides a tool which is adapted to be used to splice a wire in a fencing application. While not directed to ceiling tiles, the Tinsley device is fitted around a wire, and has a protrusion adapted to catch the free end of the wire. This again mimics the Cinque device with the protrusion acting as the rotating blade. However, the protrusion of the Tinsley device would require some care and time in which to insert the wire correctly into the protrusion, and would require the device to be operated only in one specific direction of rotation Further, since the protrusion extends outward from the handle of the device, in practise, it would catch on various devices, other tools, or the user's hands, clothing, or the like.

Other tools are known but these all suffer from similar problems, or are excessively complex and/or are difficult to install and use in the time periods required by those who work in this industry. As such, even though tools for twisting wires are well known, the common industry practise is still to hand twist the free end of the wire tie around the hanging section, and to only twist the wire tie for only two or three twists.

As such, to overcome these difficulties, it would be advantageous to provide a compact tool that could be easily installed and operated tool, and that could be used to rapidly twist a wire tie around itself, and which would automatically produce a tight coil of wire around the hanging wire tie. It would also be advantageous to provide a tool that permits a coil of eight to ten twists that can be rapidly achieved without significant exertion by the user's fingers and/or hands.

SUMMARY OF THE INVENTION

Accordingly, it is a principal advantage of the present invention to provide a wire twisting tool for use in installing ceilings and/or ceiling fixtures that is robust, inexpensive, and easy to operate.

It is a further advantage of the present invention to provide a wire twisting tool that can be used to rapidly produce a tight coil of twisted wire around a hanging wire, with minimal exertion required by the tool user.

It is a still further advantage of the present invention to provide a wire twisting tool that is easily stored by the tool user, when not in use.

The advantages set out hereinabove, as well as other objects and goals inherent thereto, are at least partially or fully provided by the wire twisting tool of the present invention, as set out herein below.

Accordingly, in one aspect, the present invention provides a wire twisting tool for use with wire ties used in supporting ceilings or ceiling components, which tool comprises a handle section which is operatively connected to a tool section, wherein the tool section comprises:

a substantially planar section having at least one planar surface;

an opening located at one edge of the planar section, and preferably located on an end of the planar section, which opening has two vertical surfaces on each side of the opening, and which opening is operatively connected to a coil forming recessed section in said planar surface, which recessed section is formed on at least one surface of said planar surface, and is subtended by a second surface, which is preferably co-planar with said planar surface, and which extends radially inward from a perimeter of said recessed section;

a passageway, defined by said radially inward extending second surface, which passageway extends completely through said tool, passes vertically through said recessed section, and which is operatively connected to said opening;

at least one concave groove located on a vertical surface of said opening, and extending outward from said recessed section.

Preferably, the coil forming recessed section has a oval shape, and the passageway is a slot in the middle of the oval recessed section. The opening is preferably a slot which extends from the end of the planar surface to meet at substantially right angles with the passageway so as to form a "T" structure.

In a further aspect, the present invention also provides a method of twisting a wire tie around itself, by using the tool of the present invention, as described hereinbelow.

The wire ties are preferably used to support ceiling panels, or acoustic tiles, which are commonly used in the building industry to provide a ceiling. This approach is commonly used in most commercial or industrial ceilings, but can also be used in residential applications. The wire ties can also be used to support other components typically found in a ceiling area and can include, for example, light fixtures, fans or other HVAC equipment, various plastic or metal pipes, electrical cables, and the like.

DETAILED DESCRIPTION OF THE INVENTION

In the present application, the term "wire twisting tools" refers to a tool which is primarily directed to twisting wire ties that are used to support ceilings and/or ceiling components. However, the skilled artisan will be aware that this tool might be used in a variety of areas, including, for example, twisting wires in fencing applications, baling applications, or for ties for supporting brick or other masonry applications. Accordingly, while the present application is hereinafter described with particular reference to the ceiling and ceiling fixture support industry, the skilled artisan would be aware that the present application is equally applicable in other applications.

As such, for brevity, the tool of the present invention will now be described for the remainder of this document with respect to ceiling and ceiling support applications only.

Further, and unless otherwise specifically noted, all of the features described herein may be combined with any of the above aspects, in any combination.

BRIEF DESCRIPTION OF THE DRAWINGS

Embodiments of this invention will now be described by way of example only in association with the accompanying drawings in which:

FIG. 2 is top view thereof;

FIG. 3 is partial cutaway side view thereof;

FIG. 4 is a cross-sectional view along the line "4-4";

FIG. 5 is a end view showing the details of the opening;

DETAILED DESCRIPTION OF THE PREFERRED EMBODIMENTS

Figure 1:
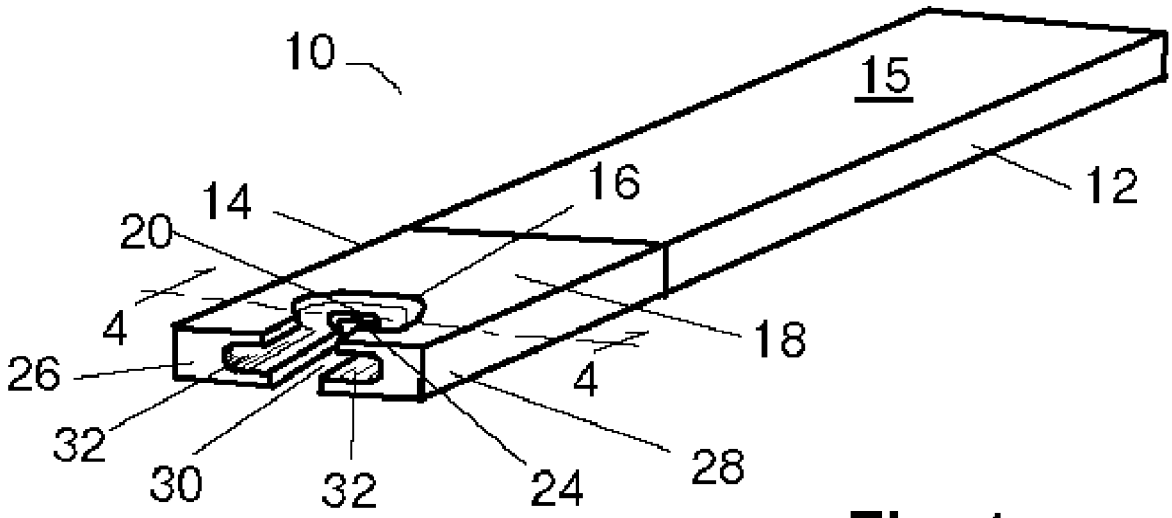
FIG. 1 is a perspective view of one preferred embodiment of a tool according to the present invention.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements, and where appropriate, recessed parts or openings are shown in outline.

It is expressly understood, however, that the drawings are for the purpose of illustration and description only and are not intended as a definition of the limits of the invention.

Referring to FIG. 1, a tool according to the present invention 10 is shown and has a handle section 12 which is integrated with tool section 14. Tool 10 is preferably made from 0.25 inch thick steel, and has a length of about 8 inches, and a width of about 1 inch. Other materials of construction might be used, such as other metals, including nickel or chrome plated iron or steel, plastics, ceramics, wood, or the like, provided that they provide the requisite strength properties for this application. Also, the overall size of the tool can also vary but typically is between 0.2 and 1 inch thick, 4 to 12 inches long, and 0.5 to 2 inches wide.

Handle section 12 extends linearly from, and is co-planar with, tool section 14. In this embodiment, it is made from the same material as tool section 14. However, handle section 12 can be any suitable handle known to those skilled in the art of tool design. For example, handle section 12 may have a plastic coating such as 15, but might also be rubber coated for easier gripping, or might be fabricated of wood, plastic or the like, and attached to tool section 12 using any suitable technique. Additionally, handle section 12 need not be flat in shape, and might be, for example, circular in cross-section, or the like.

At one end, tool section 14 has an essentially oval, coil forming recess 16 which is conveniently made by cutting into first planar surface 18. Recess 16 is preferably between 0.25 and 0.75 inches long, and defines a second, preferably planar surface 20 located at the bottom of the recess 16. Preferably, the edges of recess 16 have a slightly rounded, or curved surface 22, at the perimeter of second planar surface 20. As such, the planar surface of the tool is subtended by a second, preferably planar surface 20, at the bottom of the recess 16. Recess 16 can be any suitable shape including for example circular, triangular, square, or the like, provided that it has an edge surface which acts to bend the wire tie, in the manner described hereinbelow. However, an oval shape as shown is preferred in order to facilitate rotation of tool 10.

Essentially at the centre of oval recess 16 is a slot 24 which acts as a passageway, which slot has been drilled completely through tool section 16. Perpendicular to passageway 24, is an opening or slot 30 which extends from passageway 24 to the end 26. Alternatively slot 30 can extend to a side edge 28, of tool section 14, but it is preferred that slot 30 extend to the end 26 of tool 14.

At least one side, and preferably both vertical sides of slot 30 have a concave surface which forms a groove 32. Groove 32 preferably extends from the end 26 or edge 28 of tool section 14, to the recess 16.

As will be explained in more detail later, the purpose of groove 32 is to catch and hold the free end of the wire tie to be twisted. Providing only one groove means that the tool can be spun in only one specified direction. However, by providing two grooves on either vertical surface of slot 30, tool 10 can be spun in either direction.

Further details of construction can be seen in FIGS. 2, 3, 4 and 5 wherein details of the tool section 14, in particular, can be seen.

In FIG. 6, a series of drawings are shown which provide details on the use of tool 10. In FIG. 6A, a wire tie 40 is shown having a hanging section 42, a section 44 which has been passed through a ceiling support member 50, and a free end section 46 which has been bent so as to be roughly perpendicular to hanging section 42. Tool 10 is positioned so that hanging section 42 passes through slot 30, and is then positioned at either end of passageway 24. Slot 30 and passageway 24 are preferably sized to as to easily accommodate wire tie 40, without excessive slack. Preferably, the diameter of passageway 24 and the width of slot 30 is more than 0.05 inch greater than the typical diameter of the wire tie 40, but is preferably less than 0.2 inches greater than the diameter of wire tie 40. Passageway 24 preferably has a diameter of between 0.1 and 0.25 inches. Similarly, slot 30 preferably has a width of between 0.1 and 0.25 inches.

It is clear though, that these size differences can be exceeded, but the tool will have excessive "play" and will not perform in an optimal fashion.

In use, tool section 14 is positioned so that the opening of recess 16 is pointed towards the position where the wire coil is to be formed. In this example, recess 16 is pointed downwards as shown in the arrow in FIG. 6A.

Figure 6A:
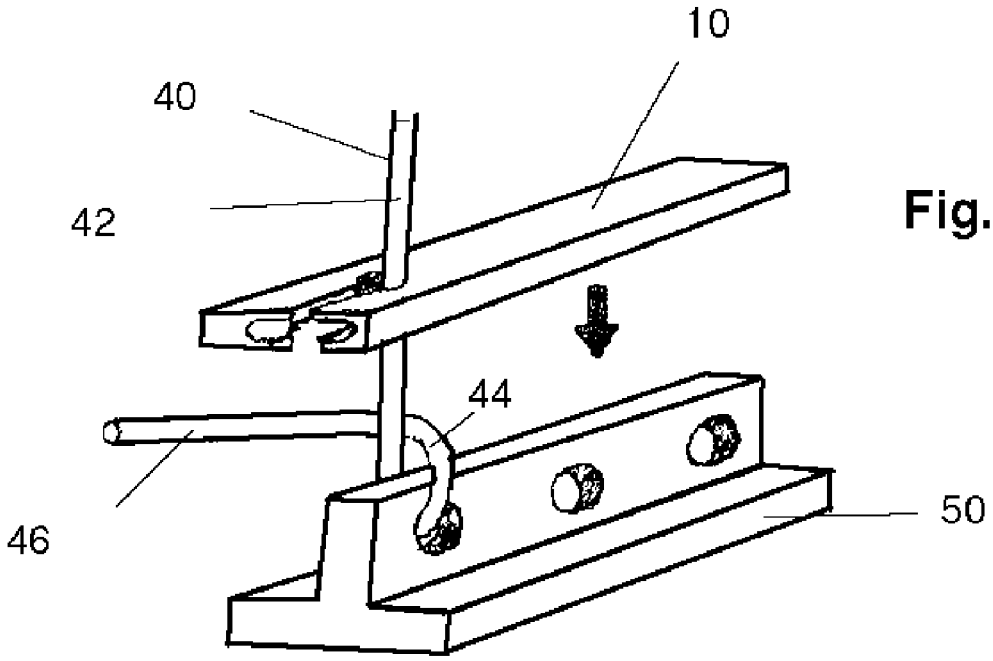
FIG. 6 is a series of drawings showing the tool in use to create a coiled wire tie that has been twisted around itself in a desired manner.
Figure 6B:
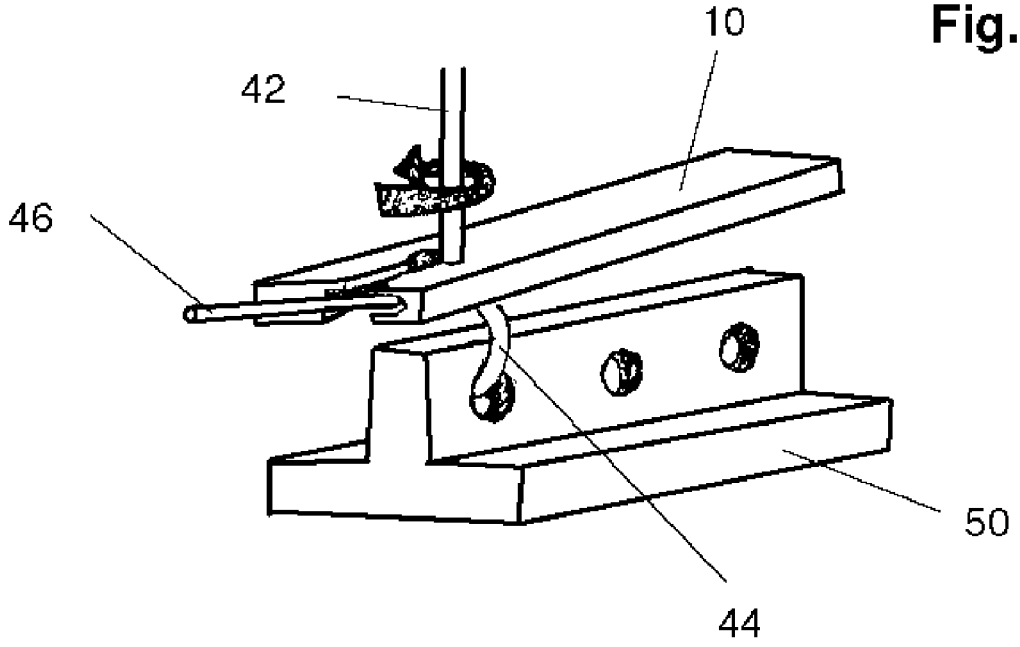
Figure 6C:
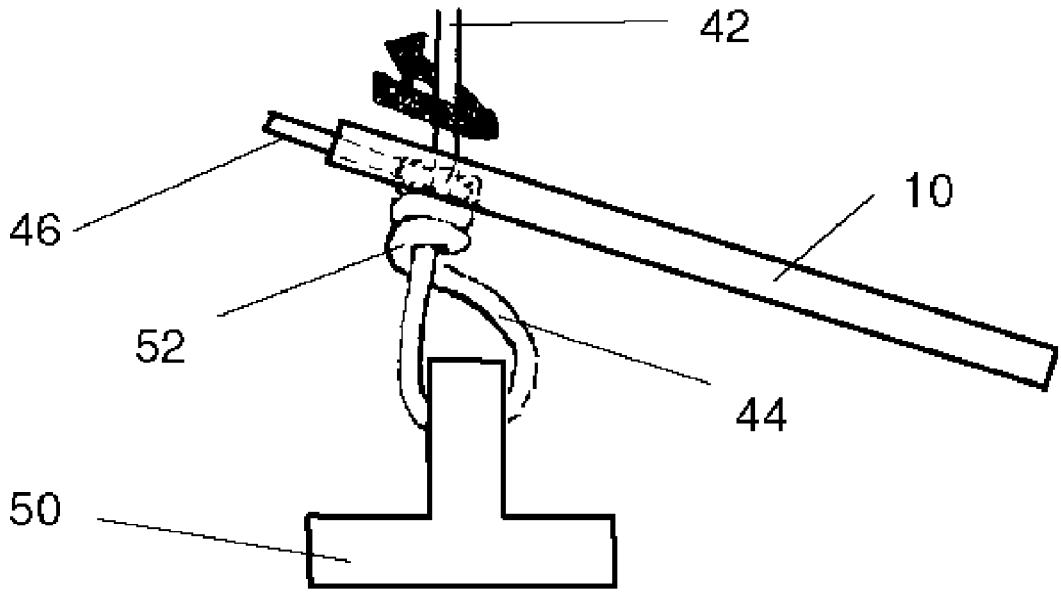
Figure 6D:
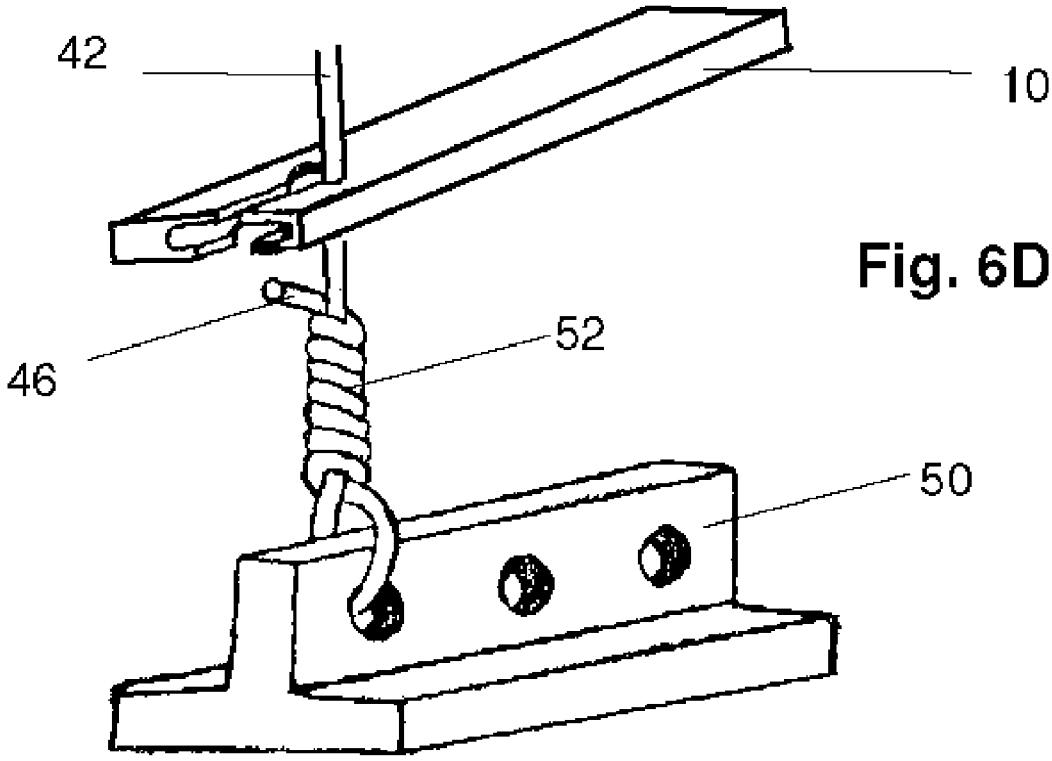

In FIG. 6B, tool 10 is moved downwards to a position where free end section 46 is positioned within slot 30. Tool 10 is then rotated around hanging section 42 so that free end section 46 is caught within a groove 32 in slot 30, and essentially pushed or pulled around hanging section 42. As this occurs, a coil 52 of twisted wire tie material forms within recess 16. As tool 10 is spun further around hanging section 42, coil 52 increases in size, and pushes circular recess 16, and thus tool 10, upwards, as seen in FIG. 6C. As such, coil 52 increases in length until preferably 8 to 10 twists of wire around hanging section 42 are formed. At that point, free end section 46 is disengaged from groove 32, tool 10 is raised further, as shown in FIG. 6D, and then tool 10 is slid away from hanging section 42 so that hanging section 42 again passes outward from tool 10 through slot 30.

The thickness of tool section 12 is preferably kept to a minimum, and preferably is only slightly larger than the thickness of wire tie 40. As such, groove 32 can be produced having a diameter which is roughly equivalent to the diameter of wire tie 40. With this arrangement, each complete twist of tool 10 around hanging section 42, produces an element of coil 52 which is located almost immediately adjacent to the previous coil element. As such, a "tight" coil can be produced, as shown in FIG. 6C, rather than a loose coil, as commonly found when the wire tie is twisted by hand.

It is to be noted that the length and size of tool 10 allows most common wire ties 40 to be easily and readily bent with minimal effort, and certainly less effort than twisting using only the users hands or fingers. Further, tool 10 can be rapidly spun around the hanging section 42 so that a coil of 8 to 10 twists of wire tie material can be produced within 5 to 15 seconds. Still further, tool 10 is compact so that it can be easily stored in a user's tool belt, or the like. Tool 10 can also be rapidly installed for use, and can be rapidly disengaged. As such, the user is able to rapidly twist a number of wire ties which will meet or exceed the applicable building code requirements, without undue exertion.

Figure 7:
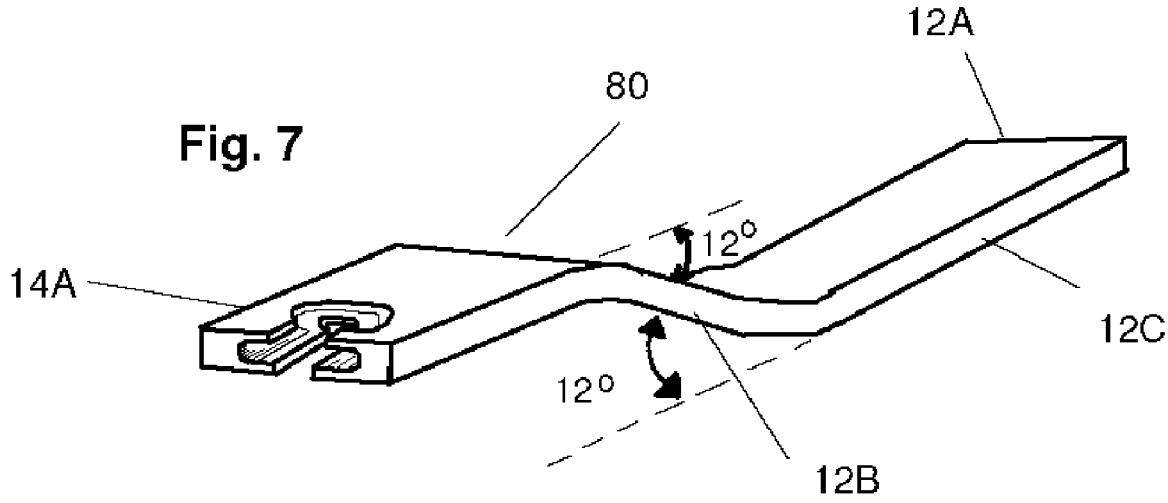
FIG. 7 is a perspective view of a second embodiment of a tool according to the present invention.

In FIG. 7, a perspective view of a second embodiment of a tool 80 of the present invention is shown. Tool 80 has a handle section 12A having two angled portions which are both angled at 12 degrees from linear, with respect to tool section 14A, as indicated. In practice, this can be done simply by bending handle section 12A from tool section 14A. This bending, which typically will preferably be at an angle of from 2 to 45 degrees, and more preferably from 10 to 30 degrees, from linear, with respect to the tool section, as shown in the linear tool shown in FIG. 1, results in a tool wherein handle section 12B and 12 C are formed, and section 12C is essentially parallel to, and offset from, the planar section of tool section 14A. This offset handle design allows the tool to be used in positions where a linear tool might not function well. For example, this might be in a position where a wall or other obstruction might be in the way of the rotation of a linear tool, or where a coil of material is needed to be positioned close to another structure.

Figure 8:
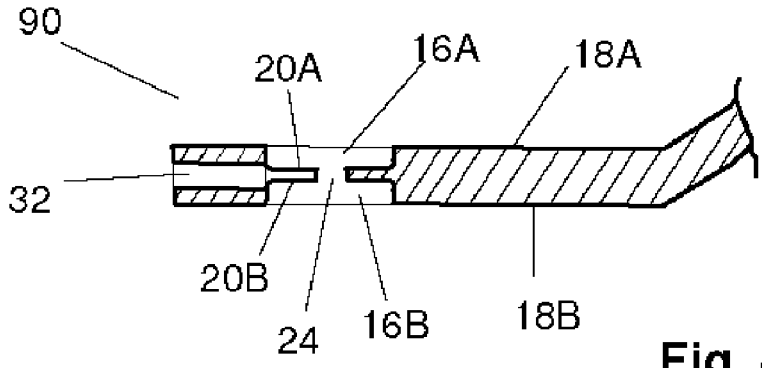
FIG. 8 is a cross-sectional view of a third embodiment of a tool according to the present invention.

In FIG. 8, a cross-sectional, partial view of a tool 90 is shown as a further embodiment, wherein two oval shaped recesses 16A and 16B have been provided on the two first planar surfaces 18A and 18B, and two second surfaces 20A and 20B have been provided within recesses 16A and 16B. Passageway 24 is located at the centre of recesses 16A and 16B, and is operatively connect to slot 30.

With this design, tool 90 can be inserted so that either surface is pointed upwards or downwards, and tool 90 can be rotated in either direction. This option allows tool 90 to be used in a fashion wherein a coil of wire can be first produced at one end of hanging section 42, as hereinabove described, and then slid along wire tie 40 to produce a coil of wire at a second end of hanging section 42. This might be done, for example, when the wire tie is first twisted to attach it to a ceiling support structure grid, bracket or the like, and then slid down to be twisted to attach it to a ceiling tile support, pipe, or the like.

As a result, tool 90 can be used facing upwards or downwards, and can be spun in either direction allowing maximum flexibility for the user.

Thus, it is apparent that there has been provided, in accordance with the present invention, a wire twisting tool which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

I claim:

1. A wire twisting tool for use with wire ties used in supporting ceilings or ceiling components, which tool comprises a handle section which is operatively connected to a tool section, wherein the tool section comprises:

a substantially planar section having at least one planar surface;

an opening located at one edge of the planar section, which opening has two vertical surfaces on each side of the opening, and which opening is operatively connected to a coil forming recessed section in said planar surface, which recessed section is formed on at least one surface of said planar surface and is subtended by a second surface, and which extends radially inward from a perimeter of said recessed section;

a passageway, defined by said radially inward extending second surface, which passageway extends completely through said tool, passes vertically through said recessed section, and which is operatively connected to said opening;

at least one concave groove located on a vertical surface of said opening, and extending outward from said recessed section.

2. A wire twisting tool as claimed in claim 1 wherein said passageway is located on an end of the planar section.

3. A wire twisting tool as claimed in claim 1 wherein said second surface is co-planar with said planar surface.

4. A wire twisting tool as claimed in claim 1 wherein said coil forming recessed section has a oval shape, and said passageway is a slot in the middle of said oval shaped recessed section.

5. A wire twisting tool as claimed in claim 4 wherein said opening is a slot which extends from the end of the planar surface to meet at substantially right angles with said passageway to form a "T" structure.

6. A wire twisting tool as claimed in claim 1 comprising two concave grooves located on each of said vertical surfaces of said opening, so that said grooves are located on opposite surfaces of said opening.

7. A wire twisting tool as claimed in claim 1 comprising a second coil forming recessed section on a second planar surface so as to form two coil forming recessed sections located on opposite and opposed planar surfaces of said tool section, each recess section being subtended by a second surface, and which second surfaces together form a surface bisecting said tool section, and which surface separates said recessed sections, and wherein said surface extends inward from the perimeters of said recessed sections.

8. A wire twisting tool as claimed in claim 1 wherein said coil forming recessed section has a diameter adapted to hold a wire coil formed around a central wire located at the centre of said coil.

9. A wire twisting tool as claimed in claim 1 wherein said opening is a slot extending from said passageway to the end of said tool section.

10. A wire twisting tool as claimed in claim 9 wherein said slot has a width, and said passageway has a diameter, which is between 0.05 and 0.2 inches greater than the diameter of a wire tie to be twisted.

11. A wire twisting tool as claimed in claim 9 wherein said slot has a width, and said passageway has a diameter, of between 0.1 and 0.25 inches.

12. A wire twisting tool as claimed in claim 1 wherein said coil forming recessed section has a diameter of between 0.25 and 0.75 inches.

13. A wire twisting tool as claimed in claim 1 wherein said handle section is essentially linear, and co-planar with said tool section.

14. A wire twisting tool as claimed in claim 1 wherein said handle section is angled so as to be between 5 to 20 degrees from linear, with respect to the tool section.

* * * * *